US006328501B1

(12) United States Patent
Gimbert

(10) Patent No.: US 6,328,501 B1
(45) Date of Patent: Dec. 11, 2001

(54) METHOD OF MANUFACTURING A TUNNEL OR SHAFT LINING OR PIPELINE

(75) Inventor: Alan William Gimbert, Southwell (GB)

(73) Assignee: Tarmac Heavy Building Materials UK Limited, West Midlands (GB)

( * ) Notice: Subject to any disclaimer, the term of this patent is extended or adjusted under 35 U.S.C. 154(b) by 0 days.

(21) Appl. No.: 09/319,293

(22) PCT Filed: Oct. 7, 1998

(86) PCT No.: PCT/GB98/02996

§ 371 Date: Jun. 3, 1999

§ 102(e) Date: Jun. 3, 1999

(87) PCT Pub. No.: WO99/18331

PCT Pub. Date: Apr. 15, 1999

(30) Foreign Application Priority Data

Oct. 7, 1997 (GB) ..... 9721128

(51) Int. Cl.[7] ..... E21D 11/00; E21D 11/10; E21D 9/00

(52) U.S. Cl. ..... 405/135; 405/134; 405/151; 405/152; 285/45; 285/55; 285/293.1

(58) Field of Search ..... 405/134, 135, 405/151, 152, 153, 147; 285/45, 55, 293.1, 419, 373

(56) References Cited

U.S. PATENT DOCUMENTS

| | | | | |
|---|---|---|---|---|
| 1,378,158 | * | 5/1921 | Jackson et al. | 405/151 |
| 2,077,137 | * | 4/1937 | Wilkoff | 405/151 |
| 3,671,346 | | 6/1972 | Tsuzuki . | |
| 3,707,846 | * | 1/1973 | Leblond et al. | 405/152 |
| 3,815,370 | | 6/1974 | Lennox . | |
| 3,861,154 | * | 1/1975 | Cooper | 405/152 |
| 4,318,636 | * | 3/1982 | Thomas | 405/153 |
| 4,318,637 | * | 3/1982 | Oger et al. | 405/153 |
| 4,647,256 | | 3/1987 | Hahn et al. . | |
| 4,820,575 | * | 4/1989 | Koelzer | 428/240 |
| 5,399,195 | * | 3/1995 | Hansen et al. | 106/711 |
| 5,549,416 | * | 8/1996 | Thomas et al. | 405/153 |
| 5,779,838 | * | 7/1998 | Fellers et al. | 156/195 |
| 5,792,529 | * | 8/1998 | May | 428/36.2 |
| 5,922,626 | * | 7/1999 | Pelzer | 442/394 |
| 6,090,319 | * | 7/2000 | Sharma et al. | 264/108 |

FOREIGN PATENT DOCUMENTS

| | | | | |
|---|---|---|---|---|
| 1806902 | * | 6/1970 | (DE) | 405/152 |
| 25 22 789 A | | 4/1975 | (DE) . | |
| 38 00 630 A | | 7/1989 | (DE) . | |
| 1 574 957 A | | 7/1969 | (FR) . | |
| 2 188 489 A | | 1/1974 | (FR) . | |
| 2069569 | * | 8/1981 | (GB) | 405/152 |
| 2 149 833 A | | 6/1985 | (GB) . | |
| 01-154996 | | 6/1989 | (JP) . | |
| 01 256699 A | | 10/1989 | (JP) . | |
| 401256699 | * | 10/1989 | (JP) | 405/153 |
| 02 035196 A | | 5/1990 | (JP) . | |
| 403059300 | * | 3/1991 | (JP) | 405/153 |
| WO 98 16721 A | | 4/1998 | (WO) . | |

* cited by examiner

*Primary Examiner*—Thomas B. Will
*Assistant Examiner*—Alexandra K. Pechhold
(74) *Attorney, Agent, or Firm*—Marshall, Gerstein, & Borun

(57) ABSTRACT

A method of manufacturing a tunnel (10) or shaft lining or pipeline of segments (12), wherein each segment (12) comprises a concrete body (11) having an extrados (13) surface, an intrados (14) surface and first and second ends (15, 16) and first and second sides (17, 18), the ends (15, 16) and sides (17, 18) providing edge portions, the segments (12) being adapted to be connected to further similar segments (12) with edge portions adjacent edge portions of adjacent segments (12), the method being characterized in that the method includes enveloping the ends (15, 16) or sides (17, 18) of at least a pair of segments (12) in a reinforcing material as the concrete is cast, and once the concrete has cured, connecting the segments (12) together with one of each of their enveloped ends (15, 16) or sides (17, 18) adjacent, and sealing between the enveloped ends or sides.

11 Claims, 3 Drawing Sheets

FIG. 1
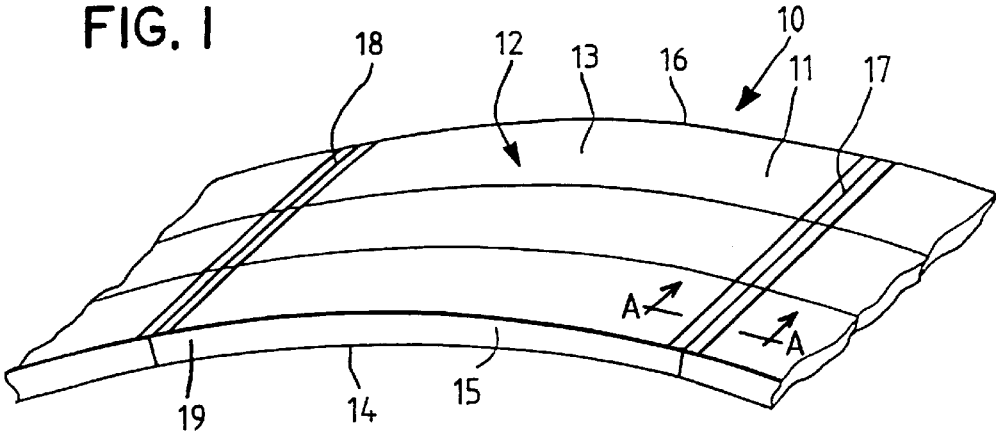
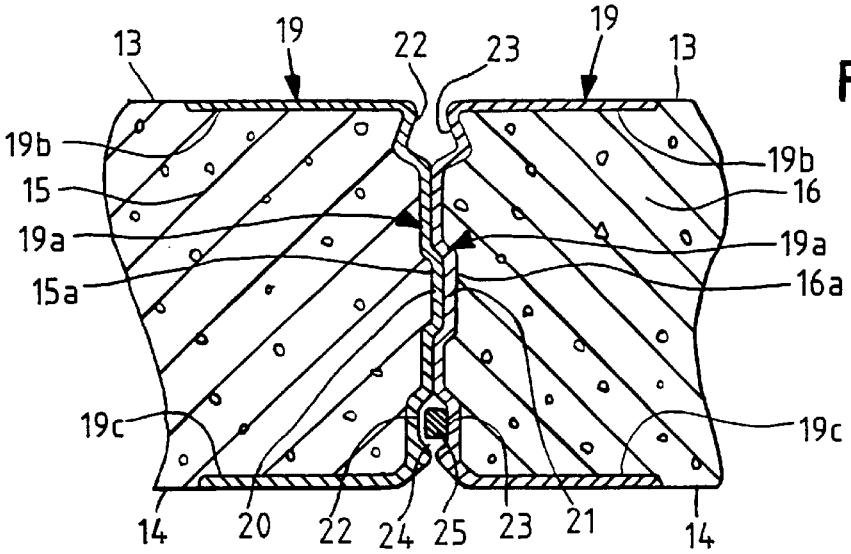
FIG. 2
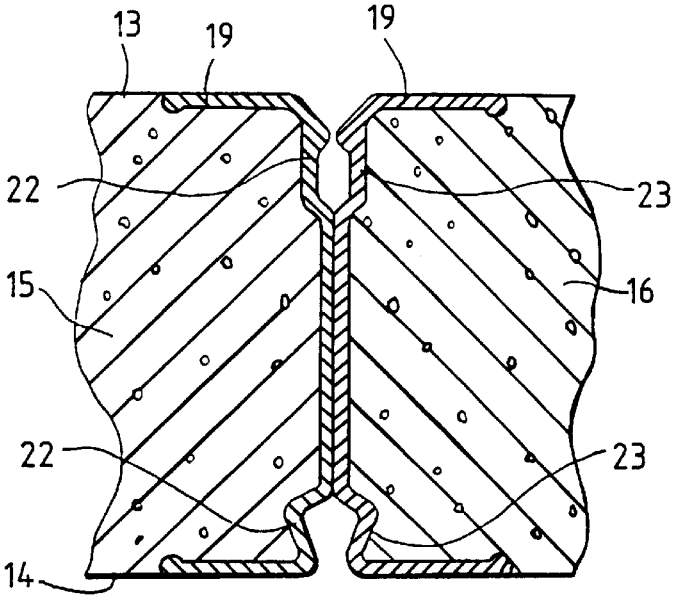
FIG. 3

METHOD OF MANUFACTURING A TUNNEL OR SHAFT LINING OR PIPELINE

BACKGROUND TO THE INVENTION

This invention relates to a method of manufacturing a tunnel or shaft lining or pipeline of segments each of which is adapted to be connected to further segments.

For brevity the remainder of this specification will refer in general to tunnel linings, but this should in all situations be taken also to include shaft linings and the like. Where appropriate pipelines will also be discussed.

It is well known to manufacture of tunnel linings using curved segments connected end to end and side to side. In addition the manufacture of pipe linings from segments connected end to end is also well known. Such segments typically are formed from concrete with internal reinforcement of steel bars. However, there are disadvantages with such internally reinforced segments both in terms of the gradual degradation of the steel reinforcement and in terms of sealing the segments in fluid tight fashion to one another. This latter disadvantage is largely as a result of the nature of the concrete surfaces against which such seals press, which commonly have many irregularities.

Japanese patent specification JP01-154996 there is disclosed a method of making a curved lining segment in which a concrete core is lined externally with fibre reinforced cement mouldings. Each of a pair of mouldings is of a generally tray shaped configuration having a base and outstanding sides. The mouldings are arranged with the outstanding sides of the two trays facing one another. Concrete is then introduced into a substantially closed cavity thus produced, to form the segment.

Such a construction may simplify the manufacturing process, but it is necessary for the core to be provided with reinforcement as the cement mouldings will not provide substantial structural strength to the core.

First, this is because of the nature of cement mouldings. Cement, like concrete is not strong in tension, which is why it is essential to provide concrete with some reinforcement which is strong in tension.

Second, if such internal reinforcement was not included in the construction described in the earlier Japanese patent specification, it would be necessary for the edge portions, or at least a pair of the edge portions of the concrete core, to be reinforced to give the segment tensile strength. In the Japanese construction though, the outstanding sides of the two trays meet along the edge portions of the concrete body, so that regardless of the material from which the cement mouldings may alternatively be made, the mouldings cannot give any substantial reinforcement to the segment where such reinforcement is primarily needed.

SUMMARY OF THE INVENTION

According to a first aspect of the invention there is provided a method of manufacturing a tunnel or shaft lining, or pipeline section of segments, wherein each segment comprises a concrete body having an extrados surface, an intrados surface and first and second ends and first and second sides, the ends and sides providing edge portions, the segments being adapted to be connected to further similar segments with edge portions adjacent edge portions of adjacent segments, the method being characterised in that the method includes enveloping the ends or sides of a least a pair of segments in a reinforcing material as the concrete is cast, and once the concrete has cured, connecting the segments together with one of each of their enveloped ends or sides adjacent, and sealing between the enveloped ends or sides.

Thus the tunnel or shaft lining or pipeline is made of generally curved, segments which are each reinforced by external reinforcement material.

Most conveniently the reinforcing material of each segment is provided by a pair of generally "C" or channel shaped reinforcing members each having an edge part which in use extends alongside an edge portion of the concrete body, and a pair of spaced generally parallel flanges which are integral with the edge part of the reinforcement member and in use each overlies a part of the intrados or extrados surface and the method further includes making each of the segments by supporting a pair of reinforcing members generally parallel to but spaced from one another, and casting concrete into the space between the reinforcement members so that opposing edge portions of the concrete body thus formed, are enveloped by the reinforcement members.

Thus there is no discontinuity in the reinforcing material along the reinforced sides or ends.

If desired, usually largely for cosmetic reasons, and to facilitate the casting in concrete of the, usually curved, intrados or extrados surfaces, at least one of an extrados and intrados surface covering member is provided, which may be supported relative to the reinforcement members so as to form a cavity into which the concrete is cast.

Such covering member will add little strength to the segment but will enable an extrados and/or intrados surface of improved finish to be produced, thus reducing or even eliminating finishing work within the tunnel or shaft lining or pipeline, which otherwise may be required.

Preferably a covering member is provided for both the intrados and extrados surfaces, which covering members are supported relative to the reinforcement members during concrete casting, and if desired additional covering members may be provided for each of the sides or ends which are not enveloped by the reinforcement material. Thus the method may comprise supporting the additional covering members relative to the reinforcement members and the covering members for the intrados and extrados surfaces, so as to form a substantially closed cavity, and introducing the concrete into the cavity through a passage provided in one of the covering or additional covering members under pressure.

So that the reinforcement material enveloping the ends or sides of the segment can be made as thin, strong and light as possible, the reinforcement members are preferably made in a fibre reinforced plastic material, with fibres of the reinforcement extending generally along the reinforcement member. The reinforcement members may be made by pultrusion or another suitable method.

The fibre reinforcement may comprise continuous filament mat and stitch bonded roving cloth and the plastic may comprise resin.

During construction of the lining or pipeline, a sealing member may be located between adjacent enveloped ends or sides of a pair of segments, prior to the segments being connected or finally connected to one another. Thus the sealing member may be compressed between reinforcing material enveloping the adjacent ends or sides as the end or sides are connected together, although, a hydrophilic kind of sealing member may alternatively/additionally/integrally be provided.

According to a second aspect of the invention we provide a method of manufacturing a lining segment comprising a concrete body having an extrados surface, an intrados surface and first and second ends and first and second sides, the ends and sides providing edge portions, the segment being adapted to be connected to a further similar segment with an edge portion adjacent an edge portion of the further segment, the method being characterised in that the method includes enveloping the ends or sides of the segment in a reinforcing material as the concrete is cast, and permitting the concrete to cure.

According to a third aspect of the invention we provide a lining segment comprising a concrete body having an extrados surface, an intrados surface, first and second ends and first and second sides, the ends and sides providing edge portions, characterised in that the ends or sides are enveloped by reinforcing material.

The reinforcing material of the segment of the third aspect of the invention may provided by a pair of edge reinforcement members each comprising a generally "C" or channel shape provided by an edge part which in use extends alongside an edge portion of the concrete body, and a pair of spaced generally parallel flanges which are integral with the edge part of the reinforcement member and in use each overlies a part of the intrados or extrados surface.

By virtue of the use of reinforcement members, the reinforced sides or ends of the segment may be made to other than simple plane shape. For example the edge part of one of the pair of the reinforcing members and the corresponding edge portion of the concrete body may include a male formation and the edge part of the other of the pair of reinforcing members and the corresponding edge portion of the concrete body may include a corresponding female formation, the male and female formations being adapted in use to interengage with corresponding female and male formations respectively of adjacent segments.

Thus relative location of a pair of segments during lining construction is facilitated and to improve sealing between the adjacent segments, the edge part of at least one of the pair of the reinforcing members and the corresponding edge portion of the concrete body, may include a recess formation. In use the recess formation together with an edge part of an adjacent segment may provide a cavity for receipt of a sealing member between the adjacent lining segments.

Thus the problems of sealing between bare concrete surfaces with irregularities is overcome.

The ends of the segment may be curved, following the profile of the intrados and extrados surfaces and thus in use extending generally circumferentially of the lining or pipeline, and the sides may be generally straight and thus in use extend generally longitudinally of the lining or pipeline.

The reinforcing material may envelope the ends of the concrete body and/or the sides of the concrete body.

A covering member may be provided substantially to cover the extrados and/or the intrados surface.

The reinforcing material may comprise a fibre reinforced plastic material or similar, and the fibre reinforcement may comprise a continuous fibre mat and stitch bonded unidirectional roving cloth, and the plastic may comprise, resin. The reinforcing members may each be made by pultrusion, with the reinforcing fibres extending generally along the reinforcement member, or by moulding or another similar method.

According to a fourth aspect of the present invention we provide a lining of a tunnel, shaft or pipeline comprising a plurality of lining segments according to the third aspect of the invention, connected together with reinforcement material enveloped edge portions of the segments lying adjacent other similarly enveloped edge portions.

BRIEF DESCRIPTION OF THE DRAWINGS

Embodiments of the invention will now be described, by way of example only, with reference to the accompanying drawings in which:

FIG. 1 is an illustrative view of part of a short section of tunnel lining made by a method according to the invention;

FIG. 2 is a cross section through line A—A in FIG. 1, showing detail of a join between adjacent tunnel lining segments made by a method of a first embodiment;

FIG. 3 is a cross section through line A—A in FIG. 1 showing a join between adjacent tunnel lining segments made by a method of a second embodiment.

DETAILED DESCRIPTION

Figure 4:
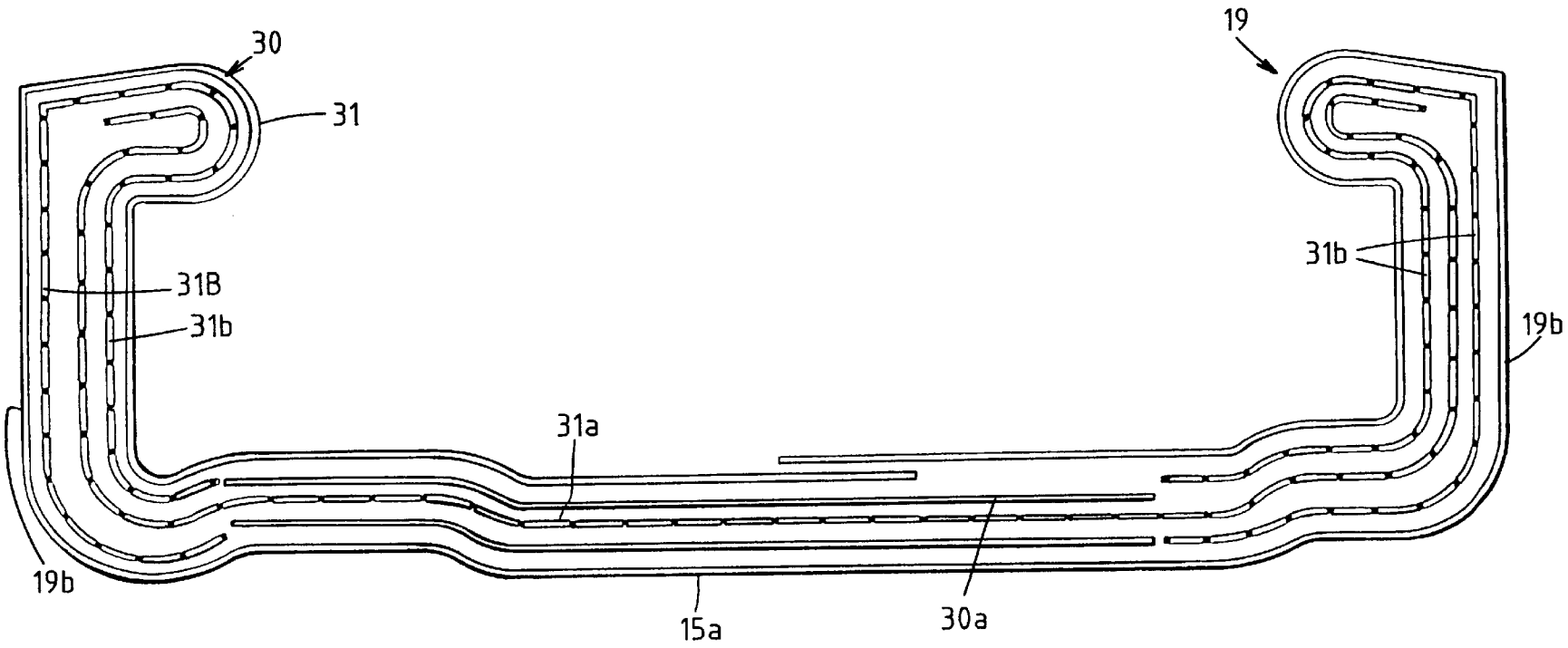
FIG. 4 is a detailed cross section through the reinforcing material of the embodiment of FIG. 3.

Referring, to FIG. 1 a tunnel lining 10 comprises a plurality of like curved tunnel segments 12. Each tunnel segment 12 is of an arched or curved shape and comprises a concrete body 11 which has an extrados surface 13, an intrados surface 14, a first end 15, a second end 16, a first side 17 and a second side 18, each of the ends and sides comprising edge portions of the concrete body 11. The ends 15, 16, are arranged circumferentially in the tunnel and thus follow the curved profile of the intrados and extrados surfaces 14,13, while the sides 17, 18, are arranged longitudinally and are thus generally straight. In his arrangement, the ends 15, 16 and sides 17, 18 are enveloped in reinforcing material 19 which is provided by reinforcing members 19 which are generally "C" or channel shaped in cross-section although in another embodiment only the ends 15, 16 or the sides 17, 18 may be so enveloped.

The ends 15, 16 and sides 17, 18 are enveloped in that the edge portions of the ends 15, 16 and sides 17, 18 of the body 11 are received within the reinforcing members 19 with an edge part 19*a* of the reinforcing member 19 extending alongside the respective end 15, 16 or side 17, 18 and integral flanges 19*b*, 19*c* overlapping peripheral portions of the intrados and extrados surfaces 13, 14 of the body 11, as will be described more fully below so that the entire edge portions are enveloped. For a typical tunnel lining segment 12 the flanges 19*b*, 19*c*, extend 45 mm onto the intrados and/or extrados surfaces 13, 14.

Figure 5:
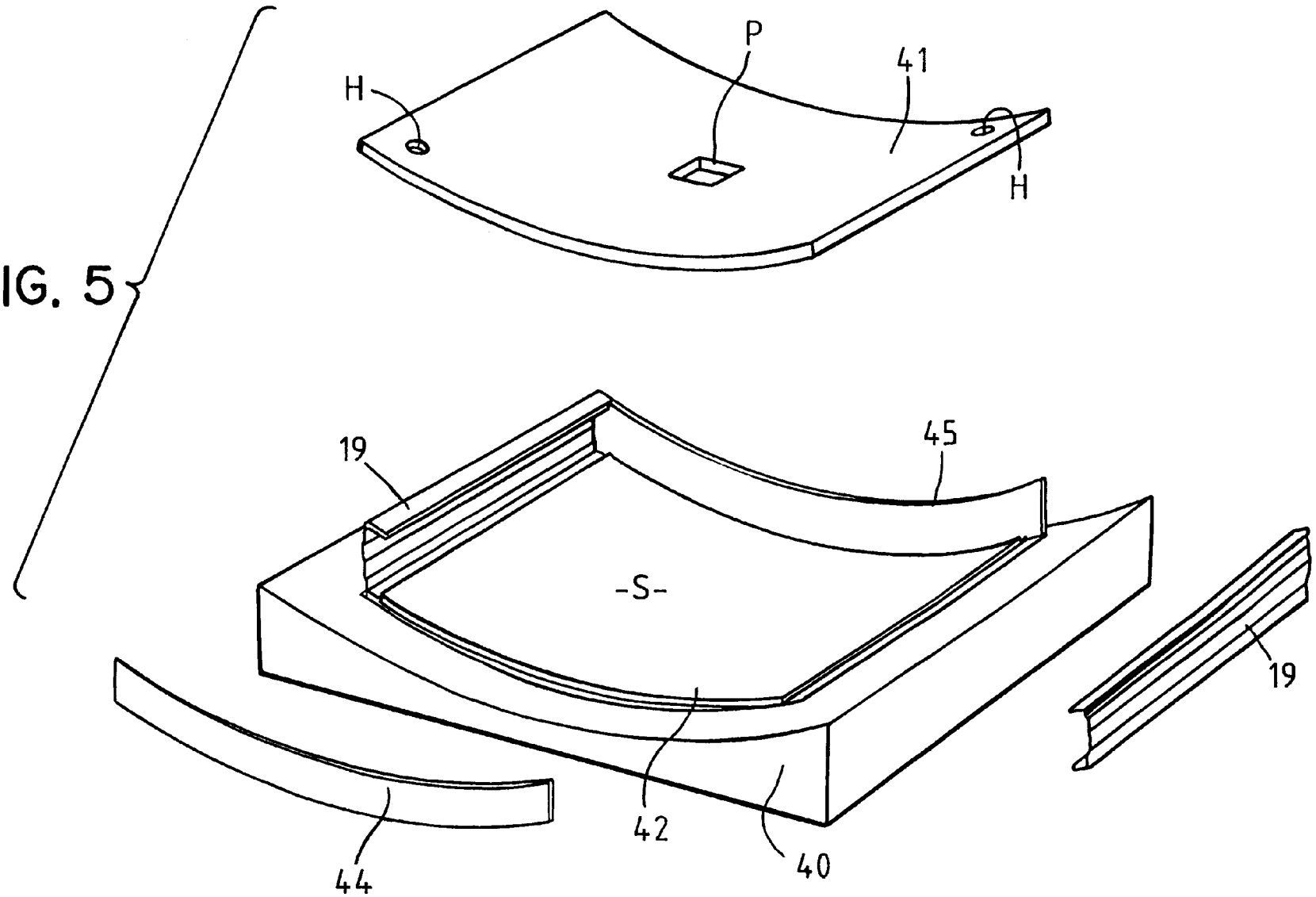
FIG. 5 is an illustrative view of a tunnel lining segment at a stage in manufacture.

Referring, to FIG. 5 particularly, each tunnel lining segment 12 is made using a mould support 40 to support a pair of reinforcing members 19 generally parallel to one another and spaced apart, the space S between the pair 19 forming a casting cavity. Although in FIG. 5, reinforcing members 19 for the ends 15, 16 of the concrete body 11 only are shown, optionally, reinforcing members to reinforce the sides 17, 18 of the body 11 may also be supported by the support 40.

In each case there is no need to provide within the mould any additional reinforcement for the concrete as the concrete body 11 when cast, will obtain sufficient reinforcement solely from the external reinforcement members 19 which envelope the ends 15, 16 and/or sides 17, 18 of the concrete body 11.

The casting cavity needs to be closed so that the space between the pair or pairs of reinforcement members 19 can be filled with concrete. This may be achieved using suitable shuttering, or as indicated in FIG. 5, by providing covering members 41,42 for the intrados and extrados surfaces 14,13, which covering members 41,42 become attached to the concrete and thus form part of the segment 12. If desired, the covering members 41,42 may be secured to the reinforcement members 19 e.g. by an adhesive or may simply be supported relative to the reinforcement members 19 by the mould support 40. In such circumstances spars may be provided to span the extrados or intrados surface covering members 41,42 during concrete casting, which spars will become enveloped in the concrete.

Where only the ends 15, 16 or sides 17, 18 of the concrete body 11 are reinforced with reinforcement members 19, the non enveloped ends or sides may be covered by covering members 44, 45 which again may be attached to the reinforcement members 19 e.g. by adhesive prior to the concrete being cast, and become attached to the concrete.

In each case, the space S between the reinforcement members 19 is then filled with concrete such that the casting cavity provided by the reinforcing members 19 and any covering members is filled. Where the casting cavity is substantially closed by the reinforcement members 19 and covering members 41, 42, 44, 45, a passage P may need to be made in one or more of the covering members to permit the concrete to be introduced, preferably under pressure to ensure that the concrete fills the cavity, there being, air escape holes H provided where necessary to permit any air trapped by the concrete to escape. Thereafter the concrete may be appropriately treated to settle the contents, and the concrete allowed to cure.

Thus the body portion 11 is formed within the reinforcing members 19, such that the ends 15, 16 and/or sides 17, 18 are enveloped at the time of manufacture. The concrete used may contain reinforcing elements, such as steel or glass fibres, within the pourable mix if so desired, although preferably the reinforcing members 19 are designed to provide sufficient overall reinforcement.

The mould support 40 may include a former of an appropriate material such as steel or wood, to ensure that the mould provided by the reinforcement members, covering members, shuttering etc. it does not twist, sag, or otherwise distort.

A plurality of tunnel lining segments 12 are used to manufacture a tunnel lining by joining them together end 15 to end 16 and side 17 to side 18 with further similar segments, as shown in FIG. 1, to produce a circular lining 10. Thus reinforcing members 19 with envelope the ends 15, 16, provide circumferential reinforcement and/or reinforcing members 19 which envelope the sides 17, 18 provide longitudinal reinforcement. Any appropriate form of connectors may be used to secure the segments 12 in place, for example connectors of the kind disclosed in British Patent No GB2131514.

The reinforcing members 19 which envelope the ends 15, 16, or sides 17, 18 may provide mating surfaces as shown in FIG. 2 at 15*a*, 16*a* for the ends 15, 16.

Referring to FIG. 2 in particular in which part of a tunnel lining made by a first method in accordance with the invention is shown in detail. A first end 15 of one segment 12 is formed within a reinforcement member 19 with a male formation 20 and a second end 16 of an adjacent similar segment 12 is formed within its reinforcement member 19 with a female formation 21. The male formation 20 and female formation 21 are adapted to inter-engage when the adjacent tunnel segments 12 are connected in use as shown in FIG. 2. The male and female formations 20, 21 provide some level of sealing between the adjacent segments 12. In addition they assist in accurate relative location of the tunnel segments 12 with respect to each other during construction of the tunnel lining 10.

The ends 15, 16 further each comprise a recess 22 and 23 formed within the reinforcement member 19. The recesses 22, 23 are adapted to cooperate with each other to provide a cavity 24 inbetween the adjacent segments 12. The cavity 24 may receive a sealing means in the form of a compressible gasket 25 and/or a gasket of or containing hydrophilic material. Alternatively, the sealing means may take the form of sealant which cures or sets after being injected, or otherwise is introduced, into the cavity 24.

If desired only one of the ends 15 or 16 may have a recess 22 or 23 which co-operates with a plain face of the opposing ends 16 or 15, but nevertheless forms a recess for a sealing means.

Referring now to FIG. 3, an alternative form of reinforcing member 19 is illustrated with like parts to the reenforcing members 19 described in relation to FIG. 2 being like referenced. In this embodiment the male and female formations ale omitted, but the recesses 22, 23 for a sealing means are retained.

Referring now to FIG. 4 details of one form of the reinforcing member 19 particularly appropriate for the embodiment of FIG. 3 is shown. The reinforcing member 19 comprises fibre reinforced plastic material in the form of a laminate. Two kinds of fibre are used, continuous filament mat (CFM) 30 typically of 300 g/m$^2$ and stitch bonded unidirectional roving cloth (SBURC) 31 typically of 900 g/m$^2$. The density of the fibre elements of the laminate is not the same for all of the area of the reinforcing material 19, as can be seen in FIG. 4. A central layer of SBURC 31*a*, is surrounded by an intermediate layer of SBURC 31*b* in the flanges 19*a*, 19*b* and of CFM 30*a* in the web or edge part XX. An outer layer of CFM 30*b* surrounds the intermediate layer 3*b* and 30*a*. The fibres of the SBURC 31 is oriented longitudinally of the reinforcing material 19. In one manufacturing method, the fibres of the laminate when laid up are immersed in an appropriate resin, for example Crystic 701 P.A. in a mould, and may be subjected to vacuum to draw the resin and embedded fibres into the mould, but any appropriate alternative manufacturing technique may be used. For example the reinforcing member 19 may conveniently be made by pultrusion.

Where the reinforcing member 19 is for a curved end 15, 16, the reinforcement member 19 will need to be correspondingly curved, so as to follow the desired profile of the extrados 13 and intrados 14 surfaces. Thus the fibres and resin would need to be moulded to an appropriate shape, preferably with the fibres following the desired curve.

Although the embodiments described above incorporate enveloped ends and sides, embodiments according to the invention may incorporate only enveloped ends or only enveloped sides.

The embodiments described above relate to tunnel linings made up of segments. However, die invention may also be applied to pipelines where the segments are often circular and therefore comprise ends but no sides, the pipeline being formed from a plurality of round segments being connected end to end.

The features disclosed in die foregoing description the following claims or the accompanying drawings, expressed in their specific forms or in terms of a means for performing the disclosed function, or a method or process for attaining the disclosed result, or a class or group of substances or compositions, as appropriate, may, separately, or in any combination of such features, be utilised for realising the invention in diverse forms thereof.

What is claimed is:

1. A method of manufacturing a tunnel or shaft lining or pipeline segments, wherein each segment comprises a concrete body having an extrados surface, an intrados surface, first and second ends, and first and second sides, the ends and sides providing edge portions, the segments being adapted to be connected to further similar segments with edge portions adjacent edge portions of adjacent segments, the method including, providing a reinforcing material including integral edge parts and overlapping flanges, the reinforcing material further including embedded fibres each extending in a same direction as the reinforcing material edge parts;

enveloping, as the concrete body is cast, the ends or sides of at least a pair of segments in the reinforcing material with the integral edge parts and overlapping flanges and with the embedded fibres all extending in the direction of the edge portion to be reinforced, the edge parts of the reinforcing material being adjacent one of the ends and sides of the concrete body, the overlapping flanges being adjacent the intrados and extrados surfaces, the intrados and extrados surfaces being substantially uncovered by the overlapping flanges; and once the concrete body has cured, connecting the segments together with one of each of their enveloped ends or sides adjacent, and sealing between the enveloped ends or sides.

2. A method according to claim 1 wherein the reinforcing material of each segment is provided by a pair of generally channel shaped reinforcing members each having an edge part which in use extends alongside the edge portion of the concrete body, and a pair of spaced generally parallel flanges which are integral with the edge part of the reinforcement member and in use each overlies a part of the intrados and extrados surface and the method further including making each of the segments by supporting a pair of reinforcing members generally parallel to but spaced from one another, and casting concrete into a space between the reinforcement members so that opposing edge portions of the concrete body thus formed, are formed by the reinforcement members.

3. A method according to claim 2 wherein at least one of an extrados and intrados surface covering member is provided, which is supported relative to the reinforcement members so as to form a cavity into which the concrete is cast.

4. A method according to claim 3 wherein the covering member is provided for both the intrados and extrados surfaces, which covering members are supported relative to the reinforcement members and relative to each other during concrete casting.

5. A method according to claim 4 wherein additional covering members are provided for each of the sides or ends which are not enveloped by the reinforcement material, and the method comprises supporting the additional covering members relative to the reinforcement members and the covering members for the intrados and extrados surfaces, so as to form a substantially closed cavity, and introducing the concrete into the cavity through a passage provided in one of the covering or additional covering members under a pressure.

6. A method according to claim 1 wherein the method includes making the reinforcing material from a fibre reinforced plastic material.

7. A method according to claim 6 wherein the reinforcing material is made by pultrusion.

8. A method according to claim 6 wherein the fibre reinforced plastic material comprises continuous filament mat and stitch bonded roving cloth and resin.

9. A method according to claim 1 wherein a sealing member is located between adjacent enveloped ends or sides of a pair of segments, prior to the segments being connected to one another.

10. A method according to claim 9 wherein the sealing member is compressed between reinforcing material enveloping the adjacent ends or sides as the end or sides are connected together.

11. A method of manufacturing a lining segment comprising a concrete body having an extrados surface, an intrados surface and first and second ends and first and second sides, the ends and sides providing edge portions, the segment being adapted to be connected to a further similar segment with an edge portion adjacent an edge portion of the further segment, the method including, providing a reinforcing material including integral edge parts and overlapping flanges, the reinforcing material further including embedded fibres each extending in a same direction as the reinforcing material edge parts;

enveloping, as the concrete body is cast, the ends or sides of the segment in the reinforcing material being adjacent edge parts and overlapping flanges and with the embedded fibres all extending in the direction of the edge portion to be reinforced, the edge parts of the reinforcing material being adjacent one of the ends and sides of the concrete body, the overlapping flanges being adjacent the intrados and extrados surfaces, the intrados and extrados surfaces being substantially uncovered by the overlapping flanges; and permitting the concrete body to cure.

* * * * *